US005475946A

United States Patent [19]

Howe

[11] Patent Number: 5,475,946

[45] Date of Patent: Dec. 19, 1995

[54] DOOR DRAUGHT AND WEATHER EXCLUDER

[76] Inventor: Ian Howe, 19 Ryan Road, Pakenham, Victoria 3810, Australia

[21] Appl. No.: 244,649

[22] PCT Filed: May 29, 1992

[86] PCT No.: PCT/AU92/00249

§ 371 Date: Jun. 6, 1994

§ 102(e) Date: Jun. 6, 1994

[87] PCT Pub. No.: WO/9315298

PCT Pub. Date: Aug. 5, 1993

[30] Foreign Application Priority Data

Jan. 23, 1992 [AU] Australia ..... PL0567

[51] Int. Cl.[6] ..... E06B 1/70; E06B 7/232

[52] U.S. Cl. ..... 49/470; 49/496.1

[58] Field of Search ..... 49/470, 496.1, 49/475.1

[56] References Cited

U.S. PATENT DOCUMENTS

| | | | |
|---|---|---|---|
| 2,240,181 | 4/1941 | Fairbank | 49/496.1 X |
| 2,247,435 | 7/1941 | Cerny . | |
| 2,293,292 | 8/1942 | Goellner . | |
| 3,359,688 | 12/1967 | Konolf | 49/496.1 X |
| 3,535,824 | 11/1970 | Kessler . | |
| 3,581,884 | 6/1971 | Caldwell . | |
| 4,497,137 | 2/1985 | Nelson | 49/496.1 |
| 4,509,999 | 4/1985 | Sandor . | |
| 4,525,953 | 7/1985 | Stutzman . | |
| 5,010,691 | 4/1991 | Takahashi . | |
| 5,093,968 | 3/1992 | Rojdev et al. | 49/475.1 X |

FOREIGN PATENT DOCUMENTS

| | | | |
|---|---|---|---|
| 7898082 | 8/1982 | Australia . | |
| 35655 | 5/1986 | Australia . | |
| 53801 | 12/1981 | European Pat. Off. . | |
| 391700 | 10/1990 | European Pat. Off. . | |
| 2262187 | 9/1975 | France . | |
| 153537 | 5/1970 | New Zealand . | |
| 181165 | 1/1981 | New Zealand . | |
| 186507 | 3/1981 | New Zealand . | |
| 205420 | 4/1988 | New Zealand . | |
| 210090 | 5/1988 | New Zealand . | |
| 213476 | 3/1989 | New Zealand . | |
| 185945 | 3/1989 | New Zealand . | |
| 187957 | 2/1937 | Switzerland . | |
| 219599 | 6/1942 | Switzerland . | |
| 223469 | 3/1943 | Switzerland . | |
| 306786 | 2/1921 | United Kingdom . | |
| 597336 | 2/1948 | United Kingdom . | |
| 625755 | 7/1949 | United Kingdom . | |
| 881766 | 11/1961 | United Kingdom . | |
| 1083336 | 9/1967 | United Kingdom . | |
| 1235025 | 6/1971 | United Kingdom | 49/496.1 |

*Primary Examiner*—Philip C. Kannan
*Attorney, Agent, or Firm*—Lane, Aitken & McCann

[57] ABSTRACT

A draught and weather excluder comprising a gap sealing section which enables simple, fast and effective closure of gaps below hinged and sliding doors is disclosed. The sealing section may be simply fitted to the underside of a door edge using strips of bonding tape so that the device may be fitted without removing or modifying the door in anyway. The sealing section comprises two main webs, a mounting web and a sealing web, which are connected together along the length of the section by a hinged or weakened section. The mounting web consisting of a generally thin flat flexible web for flush mounting the sealing section directly to the underside of a door edge. The sealing web consists of a generally curved or non-linear cross section for making contact with and freely sliding over floor surfaces including floor coverings and for actively mounting obstacles on the floor. The sealing web may contain a nose portion extending from the free extremity of the sealing web so as to allow the sealing web to glide freely and smoothly over a floor surface without fouling as the door is rotated in either direction. The nose portion may contain a biasing web extending from its free extremity and extending upwardly and inwardly towards the hinge. The biasing web being able to make contact with the mounting web during upward rotation of the sealing web. The sealing section has a generally constant cross section and may be produced in long lengths of resilient flexible type materials such as plastic.

18 Claims, 2 Drawing Sheets

DOOR DRAUGHT AND WEATHER EXCLUDER

This invention relates to improvements in devices for restricting the passage of air and moisture through the gaps between doors and the floor and in particular for restricting the passage of air and moisture through the gap between the door and the floor at the bottom of doors along the full width of the door.

Existing methods of restricting draught and weather at the gap at the bottom of doors take several forms. One common method involves the manual placement of a device such as a soft flexible tubular container filled with sand, cloth or other filling so that the device may be manually pushed against the gap so that the device takes up the shape of the gap and restricts draught through the gap. Such devices are unsightly and cumbersome. Another common method is similar to the above method except that there is a mounting mechanism which must be screwed to the face of the door so that the tubular section moves with the door. Such devices are bulky, unsightly and can foul with the cavity in cavity sliding doors. Another common method involves the use of a mounting strip containing a brush type material. The mounting strip must be fixed to the face of the door. This method is unsightly and can damage the face of the door. Another common method is to provide a mounting strip which contains a hinging mechanism which houses a resilient gasket. The hinge mechanism strikes a biasing stop when the door is closed so that the gasket is forced toward the floor surface. This method is unsightly and limited to external hinged door use. Another common method is to provide a two part mechanism where one part is mounted to the underside of the door and the other part is mounted to the surface of the floor. This method is limited to external hinged doors and can make the door more difficult to operate.

The present invention provides a device for simply and effectively excluding draught and weather from penetrating the gap at the base of a door. This invention also provides a device which is concealed beneath the underside of the door. It also provides a device which does not require fixing to the door by the use of screws or nails. It also provides a device which can be simply and effectively fixed to the door without removing the door. It also provides a universal device for broad use. It also provides a device which does not require fixing to the face of the door. It also provides a single part device which seals a wide range of variation in a single gap. It also provides a device which does not reduce the ease with which a door can be opened or closed. It also provides a device which actively clamps down onto the floor surface without the need for complimentary devices such as biasing stops. It also provides a device which does not require adjustment when used to seal a gap whose sides are not parallel along its length. It also provides a device which in use does not mar soft floor coverings. It also provides a device which in use has no components which are subject to significant wear or deterioration. It also provides a device which is suited to sliding doors as well as hinged doors. It also provides a device which greatly reduces the operating forces on the fixing material when in use so that simple less strong fixing materials such as strips of bonding tape may be successfully used to fix the device directly to the underside of a door edge, without additional separate members such as a mounting cradle or modifications to the door edge such as grooving. It also provides a device which may seal the gap between the mounting web and the under side of a door edge by the use of bonding tape strips. It also provides a sealing device which is able to actively climb and pass over significant obstacles above the floor surface. It also provides a device which may provide a relatively tight seal or a relatively less tight seal in the same device. It also provides a device which does not require any complimentary devices to be fitted to the underside of a door and does not require any modification to the underside of a standard door edge such as creating grooves.

The present invention provides a draught and weather excluding device comprising a mounting web and a sealing web these webs being connected together in such a way so as to allow the sealing web to have a hinge action with the mounting web so that the sealing web is simply and effectively able to close the gap between the underside of the bottom of a door and the top surface of a floor and floor covering. Due to the hinge action between the two main webs the device has the ability to seal a substantial range of gaps between doors and floors without the need to adjust the location or configuration of the device. The device need not be fitted differently to accommodate different gaps on different doors. Due to the hinge action between the two main webs the device has the ability to automatically alter its vertical reach so that in situations where the gap width alters as the door is rotated, the device retracts or extends vertically so as not to cause any significant friction between the door and the floor.

The sealing web may be of resilient material so that in situations where the gap width is different along its length the sealing web is able to extend and retract vertically along its length so that an uneven gap may be effectively sealed.

The hinge position of the device may be located parallel to and at the furthermost edge of the underside of the door edge when viewed from within a room so that as the door is rotated toward the closed position, the sealing web is caused to be extended vertically downward so as to ensure that the gap is effectively sealed when the door reaches its closed position. That is to say that the line of contact and resulting small frictional force between the sealing web and the floor is located at a distance from the axis of the hinge so that the sealing web experiences a rotational moment couple downwardly toward the floor. Larger gaps producing a greater such moment action so that large gaps are effectively sealed when the door is in the closed position and the sealing web has not needed to rely soley on gravity forces or material resilience or hinge biasing or any spring action in order to remain in contact with the floor surface to establish an effective seal. When the door is rotated in the opening direction the moment couple is reversed thus allowing the door to rotate totally freely in the opening direction.

The sealing web may be of suitable cross sectional shape such as a curved shape so that the floor surface makes contact with the sealing web at a tangent to the sealing web so that the sealing web is able to glide freely over the floor and actively climb obstacles on the floor so as to pass over them when the door is being opened or closed, In one possible form of the invention a nose portion may be included extending from the free extremity of the sealing web toward the underside of the door edge so that the sealing web may efficiently and effectively resist fouling with the floor surface covering and so glide freely over it without significantly increasing the effort required to rotate the door when the door is being rotated in a direction away from the hinge or weakened section. A biasing web may also be included extending from the nose portion and toward the hinge or weakened section so that such a biasing web will act resiliently or by a similar spring action in contact with the mounting web so as to ensure that effective web separation takes place so that the natural gravity force acting on the sealing web, or the frictional force between the underside of the sealing web and the floor surface causing the sealing web to separate downwardly away from the mounting web and toward the floor surface need not be relied upon in situations where a relatively tighter seal is required below the door. The sealing web may be of a suitable cross sectional shape such as curve or non linear shape so as to allow the sealing web to actively mount and glide over significant obstacles on the floor surface. The present invention may be constructed from resilient flexible type materials such as plastics or similar materials which can be effectively formed into the required cross sectional shape in lengths of approximately but not restricted to one meter. To assist with understanding the invention, reference will now be made to the accompanying drawings which show two possible embodiments of the invention In the drawings:

FIG. 6 also shows the action of the biasing web in contact with the underside of the mounting web.

Figure 7:
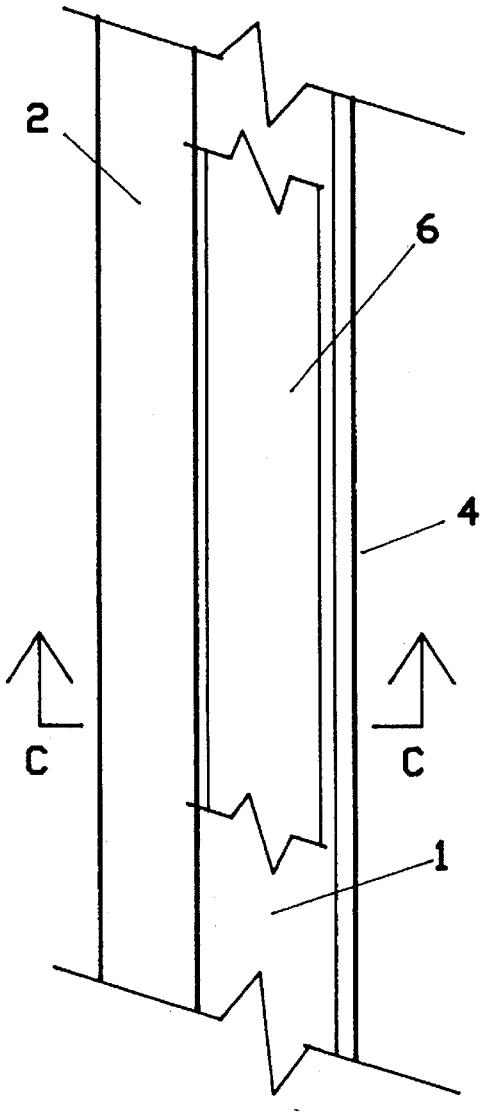
FIG. 7 shows a plan view of a long portion of the draught and weather excluder of FIG. I when viewed in the direction of arrow B.
Figure 8:
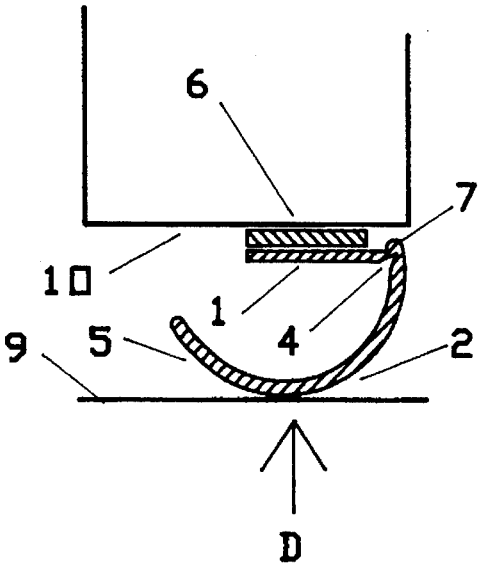

FIG. 8 shows a cross sectional view of the draught and weather excluder of FIG. 7 where the sectional view is taken through the center of the tape strip and in the direction of arrow C. FIG. 8 also shows the sealing section of FIG. 7 being in a slightly compressed state. That is to say that, prior to fitting of the sealing section to the underside of the door edge 10, the overall vertical depth of the sealing section was larger than the vertical distance from the underside of the door edge 10 to the top of the floor surface 9 prior to mounting the device.

Figure 1:
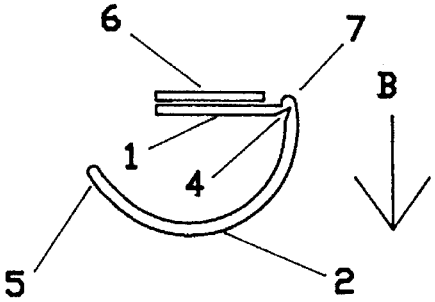
FIG. 1 shows an end view of one possible embodiment of the draught and weather excluder according to this invention.

By referring to FIG. 1 it can be seen that the draught and weather excluding device according to this invention comprises a mounting web 1, a sealing web 2, a hinge or weakened section 4 and a nose portion 5.

The sealing web 2 being connected via a hinge or weakened section 4 to the mounting web 1. The sealing web 2 containing a nose portion 5 at its free extremity. The mounting web 1 supporting a strip of bonding tape 6.

Figure 3:
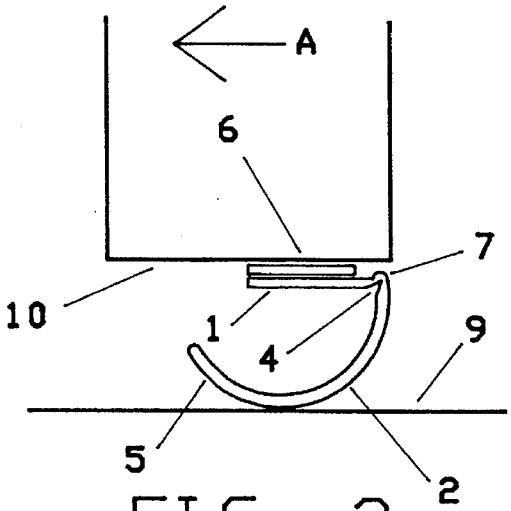
FIG. 3 shows the application of the draught and weather excluder of FIG. 1 to a relatively large door to floor gap width. Also shown in FIG. 3 is the intended action of the nose portion in assisting the sealing web to resist fouling with the floor surface and aiding it to glide smoothly and freely over the floor surface particularly when the door is rotated in the direction of arrow A.
Figure 5:
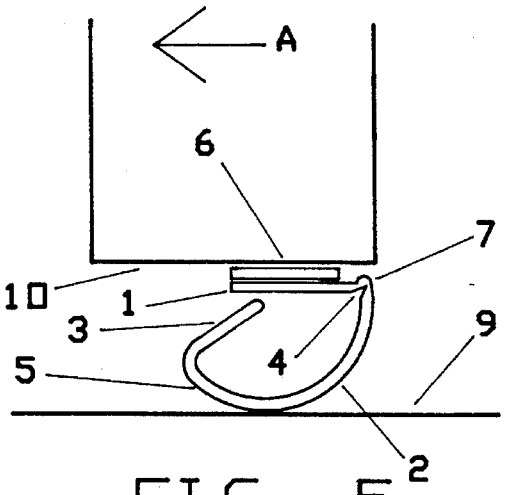
FIG. 5 shows the draught and weather excluder of FIG. 2 being used in the same application of FIG. 3.

By referring to FIG. 5 it can be seen that an alternative possible embodiment of this invention is similar to the embodiment of FIG. 3. The sealing web 2 containing a nose portion 5 formed integral with the sealing web 2 and being a general continuation of the sealing web 2.

The nose portion 5 being an extension of the sealing web 2 and being inclined at a suitable angle to the plane of the mounting web 1 so that the nose portion may assist the sealing web 2 in sliding freely and smoothly over a floor surface 9. The nose portion 5 further containing a biasing web 3 formed integral with and being a continuation of the nose portion 5.

The biasing web 3 being connected to the nose portion 5 at the extremity of the nose portion 5 furthest from the hinge or weakened section 4 and extending upwardly toward the mounting web 1 and inwardly toward the hinge or weakened section 4.

The strip of bonding tape 6 being attached to the top surface of the mounting web 1.

The upstand 7 being extended upwardly from the mounting web 1 and extending through the length of the mounting web.

By referring to FIG. 3 it can be seen that the embodiment of the sealing section of FIG. 1 is attached to the underside of a door edge 10 by use of strips of bonding tape 6. FIG. 3 also shows the inclined orientation of the nose portion 5 to the sealing web 2. FIG. 3 also shows the region of contact between the sealing section 2 and the floor surface 9. It can also be seen that in this application a preferably minimal amount of contact force is applied between the underside of the sealing section 2 and the top of the floor surface 9, so that the sealing web 2 experiences minimal sliding resistance in sliding contact with the floor surface 9. It can also be seen that the line of contact between the floor surface 9 and the underside of the sealing section 2 is along a line which is significantly displaced in a horizontal direction away from the hinge 4 and towards the free extremity of the sealing web 2 so that even at large downward angles of rotation of the sealing web the sealing web 2 is able to move freely with the door and to slide freely over the surface of the floor during door rotation when the door is rotated in the direction of arrow A. It can also be seen that the sealing web 2 is also caused to actively rotate towards the floor surface 9 by the above displacement of the line of contact and resulting moment couple when the door is rotated in the direction of arrow A.

Figure 4:
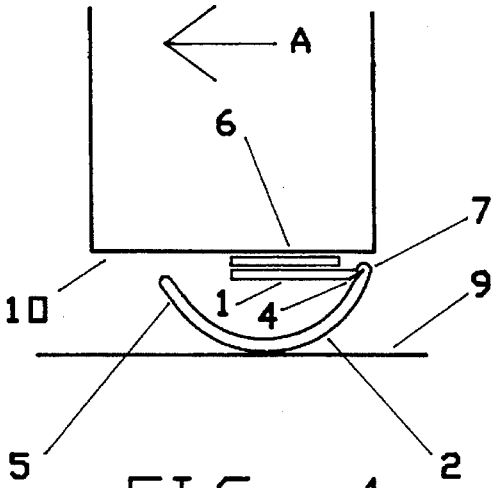
FIG. 4 shows the draught and weather excluder of FIG. 1 in an application where the sealing web has rotated upward about the hinge or weakened section so as to accommodate a relatively smaller door to floor gap.

By referring to FIG. 4 it can be seen that the sealing section of FIG. 3 by virtue of its cross sectional shape has accommodated a relatively small door to floor gap and the sealing web 2 has been caused to rotated upwards about the hinge or weakened section 4.

Figure 2:
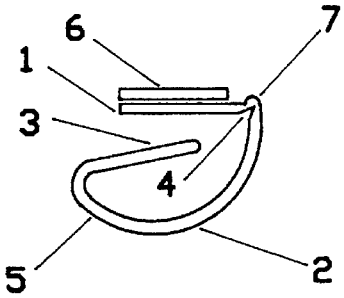
FIG. 2 shows an end view of another possible embodiment of the draught and weather excluder according to his invention.

By referring to FIG. 5 it can be seen that the embodiment of FIG. 2 is attached to the underside of the door edge 10 and is in the same application as that of FIG. 3.

Figure 6:
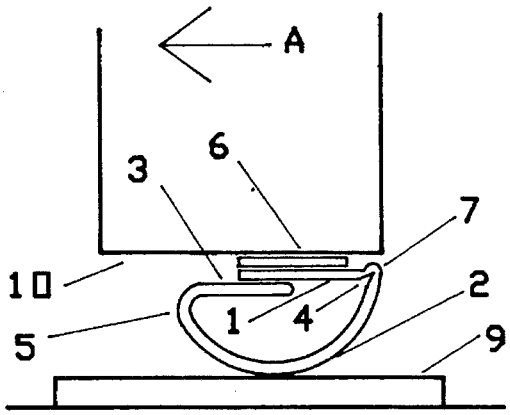
FIG. 6 shows the draught and weather excluder of FIG. 2 being used in a similar application as FIG. 4.

By referring to FIG. 6 it can be seen that the embodiment of FIG. 2 is accommodating a relatively small gap as in the application of FIG. 4. Also shown in FIG. 6 is the action of the biasing web 3 whereby the extremity of the biasing web 3 makes contact with the underside of the mounting web 1, so as to bias the sealing web in a direction downwardly and away from the mounting web 1.

By referring to FIG. 7 it can be seen that the embodiments of FIG. 1 and FIG. 2 may contain a mounting web 1 being of sufficient width so as to accept strips of bonding tape 6 being attached to the top surface of the mounting web 1.

By referring to FIG. 8 it can be seen that the device of FIG. 7 contains a mounting web I which may contain upstand 7 extending towards the underside of the door and having bonding tape strips 6 attached to it for the purpose of securing the mounting web to the underside of the door edge 10. It can also be seen that the upstand may effectively bridge the gap between the underside of the door edge and the top of the mounting web due to the thickness of the bonding tape strips 6. It can also be seen that in the region where the mounting web 1 is attached to the underside of the door edge 10 by the strips of bonding tape 6 the plane of the mounting web 1 and the plane of the bonding tape strips 6 are both parallel to the plane of the underside of the door edge 10. It can also be seen that the reaction force of the floor 9 in the direction of arrow D, causing the sealing section to be in a compressed state, has not caused the plane of the mounting web 1 to be altered in the region where the mounting web 1 is attached to the underside of the door 10 by the tape strip 6.

By referring to FIG. 3 it can be seen that the sealing web 2 is of a generally curved or non-linear shape so as to be able to mount a significant obstacles on the floor surface 9 and includes a nose portion 5 so as to assist the sealing web 2 in its intended function of sliding freely and smoothly over the floor surface 9 particularly in situations where the sealing web has rotated significantly downwardly.

The nose portion 5 having a suitable incline to the floor surface 9 so as to ensure that the sealing web 2 will glide smoothly and freely over the floor surface including floor coverings.

By referring to FIG. 4 it can be seen that the mounting web 1 is flush mountable to the door underside 10 and that the sealing web 2 is in contact with the top of the surface of the floor 9 at a tangent to the curve of the surface of the underside of the sealing web 2. It can be seen that the sealing web 2 will, by the action of gravity forces, remain in contact with the floor surface 9 for a very significantly large range of gaps. It can also be seen that as the door is being closed in the direction of arrow A, the sealing web will be actively pulled downwardly and rotated toward the top of the floor surface due to the small frictional moment caused by the floor surface 9 in contact with the sealing web 2 in conjunction with the vertical distance of this contact line from the plane of the mounting web 1 so that the sealing force between the sealing web 2 and the floor surface 9 is actively and preferably increased as the door is closed. Conversely it can also be seen that as the door is being opened in a direction opposite to arrow A, the above moment is reversed thus allowing unrestricted rotation of the door. It can also be seen that the hinge or weakened section 4 is provided such that the sealing web 2 may rotate freely at its connection line to the mounting web 1. The hinge or weakened section 4 being positioned on the mounting web 1 so that when the door is being rotated in either direction there are no resultant rotational forces on the fixing material so that the fixing material experiences compression or shear force only. It can also be seen that the fixing material comprises double sided bonding tape strips 6. Due to the action of the device in use as described above, the fixing material experiences forces which are restricted to relatively small forces which are restricted to shear forces only so that simple fixing materials such as strips of bonding tape are efficiently usable with the device.

By referring to FIG. 3 it can be seen that the nose portion 5 is so proportioned and of suitable cross sectional shape so as to provide to the sealing web 2 a continuation of the sealing web such that the the nose portion 5 actively assists the sealing web 2 in its intended action of gliding freely and smoothly over the floor surface 9 without fouling with the floor surface 9 particularly when the door is rotated in the direction of arrow A.

By the use of draught and weather excluders of this type, draughts and moisture penetration through the gap which generally exists at the base of a door may be simply and effectively sealed without modifying the door and without removal of the door and without the draught excluder protruding past the door faces and without the limitation of having a floor surface which is free of obstacles. By the use of draught and weather excluders of this type, a large range of gap depths between door edges and floors may be simply and effectively sealed without modifying or adding separate cradles or other mounting devices to the door or associated structures. Excluders of this type do not impinge upon the original intended operating ease of the door and do not impinge upon or foul with any part of the door or its associated structures. By the use of draught and weather excluders of this type, door gaps which are not constant in depth along their length and/or are not parallel to the plane of the floor surface or are not linear may be simply and effectively sealed. Draught and weather excluders of this type may be fixed to the underside of a door edge using simple and less strong fixing materials such as bonding tape strips without resulting in dislocation of the device from the underside of the door edge when the door is rotated in either direction.

Although particularly described for sealing gaps below doors the sealing section may be useful for sealing of gaps between other structures, for example the sealing of gaps between the corresponding vertical jambs of sliding doors.

It is to be understood that various alterations, modifications and/or additions may be made to the features of the possible and preferred embodiments of the invention as herein described without departing from the scope of the invention as defined in the following claims.

The claims defining the invention are as follows

I claim:

1. In combination, a floor surface;

a door mounted for movement in a direction parallel to the floor surface, the door having an underside adjacent to the floor surface; and a gap sealing section for sealing gaps between said underside of the door and the floor surface, the sealing section being secured to the underside of the door, the sealing section having a mounting web on one side directly flush mounted to the underside of the door and a sealing web at the opposite side making contact with and freely and smoothly sliding over said floor surface, the two webs being flexibly connected at one extremity along a line through their length so as to be movable by relative rotation about this line of their connection, the sealing web bearing against the top of the floor surface along a line which is generally below the area defined by the surface of the underside of the door edge.

2. The combination as claimed in claim 1, wherein the sealing section in use does not protrude past either face of the door.

3. The combination as claimed in claim 1, wherein the line of contact between the sealing web and the floor surface moves horizontally towards the line of connection of the sealing and mounting webs, this action occurring when in use the sealing web is caused to rotate upward toward the underside of the door edge.

4. The combination as claimed in claim 1 wherein the mounting and sealing webs are connected by a weakened section along their line of connection so as to allow the webs to come together and separate by their rotation about the weakened section so that rotational forces applied to either web results in relative rotation of the webs only about the weakened section so that no significant rotation occurs within the mounting or sealing web.

5. The combination as claimed in claim 1 wherein the sealing web is of generally curved, or non-linear type cross sectional shape so that the sealing web will not foul with the floor surface and will glide freely and smoothly over said floor surface along a line where the floor surface makes contact at a tangent to the sealing web, when the door is being moved.

6. The combination as claimed in claim 1 wherein the sealing web contains a nose portion along its edge opposite to the line of connection of the sealing and mounting webs so as to prevent fouling of the sealing web with the floor and to ensure that the sealing web is able to glide smoothly and freely over a floor surface and to allow a generally flat sealing section to also glide freely and smoothly over a floor surface when the door is rotated particularly in a direction away from the line of connection of the sealing and mounting webs.

7. The combination as claimed in claim 1 wherein the mounting web contains an upstand in a direction toward the underside of the door edge surface so that no gaps may occur between the top of the mounting section and the underside of the door edge.

8. The combination as claimed in claim 1 wherein the line of connection of the sealing and mounting webs contains a residual resilience such that the sealing and mounting webs are biased apart when the sealing section has been inserted into a gap which is less in overall vertical depth than the overall vertical depth of the sealing section prior to insertion into the gap, the mounting web being actively pushed up toward the underside of the door edge so that the fixing materials between the underside of the door edge and the top of the mounting section are placed in compression so that the fixing materials are not subject to forces tending to downwardly separate the mounting section from the surface of the underside of the door edge.

9. The combination as claimed in claim 1 wherein the line of connection of the sealing and mounting webs is sufficiently weak in resisting rotation so that rotation of the sealing web in use does not transmit a significant moment couple to the mounting web via its connection thereto, the mounting web so attached to the sealing web, not transmitting any significant rotational forces to the fixing material, the fixing materials in use not experiencing any significant rotational forces, the fixing materials in use experiencing significant compression and shear forces only, the mounting web being simply attachable to the underside of a door edge using fixing materials such as bonding tapes so that stronger fixing materials or rigidly fixed mating parts or modifications to the underside of the door edge are not required.

10. The combination as claimed in claim 1 wherein the sealing web cross section is constructed in a generally curved or non-linear shape so that the underside of the sealing web in contact with the floor surface provides a tangential line of contact to the floor surface, so that where the floor surface contains significant obstacles the sealing web may actively mount such obstacles encountered at the floor surface during rotation of the door in either direction, the sealing web thus formed being able to actively mount such obstacles on the floor surface during rotation of the door by virtue of the cross sectional shape of the sealing web and the ability of the sealing web to rotate upward about the line of connection of the sealing and mounting webs and towards the mounting web.

11. The combination as claimed in claim 1 wherein the sealing web extends downwardly and generally directly below the mounting web and away from the line of connection of the sealing and mounting webs, rotation of the door away from the line of web connection causing the sealing web to actively clamp down onto the floor surface due to the moment caused by the small friction force between the floor surface and the sealing web about the line of web connection, the sealing web actively releasing the clamp action when the door is rotated towards the line of web connection.

12. The combination as claimed in claim 1 wherein the sealing web is of resilient material so that in situations where the door to floor gap is different along the length of the sealing section, the sealing web is able to extend and retract vertically along its length so that an uneven gap may be effectively sealed.

13. The combination as claimed in claim 1 wherein the sealing section is of a sufficiently curved or non-linear cross section so that the floor makes contact with the sealing web at a tangent to the sealing web, the line of contact so formed between the surface of the floor and the sealing web, being always located at a horizontal distance away from the line of connection of the sealing and mounting webs so that in use the sealing web is able to glide freely and smoothly over the floor covering surface so that the sealing web glides freely and smoothly over the floor surface with door rotation as the door is rotated in either direction, and particularly when the door is rotated in a direction away from the line of connection of the sealing and mounting webs.

14. The combination as claimed in claim 1 wherein the sealing section in use does not protrude past either face of the door.

15. The combination as claimed in claim 1 wherein the line of contact between the sealing web and the floor surface moves horizontally towards the line of connection of the sealing and mounting webs, this action occurring when in use the sealing web is caused to rotate upward toward the underside of the door edge.

16. A gap sealing section for sealing gaps between the underside of a door edge and the top of a floor surface, the sealing section being securable to the underside of a door edge, the sealing section having a mounting web on one side to allow direct flush mounting to the underside of a door edge and a sealing web at the opposite side for making contact with and freely and smoothly sliding over floor surfaces including floor coverings, the two web being flexibly connected at one extremity along a line through their length so as to be movable by relative rotation about this line of their connection, the sealing web bearing against the top of a floor surface along a line which is generally below the area defined by the surface of the underside of the door edge, wherein the sealing web contains a nose portion extending from the free extremity of the sealing web opposite the line of connection of the sealing and mounting webs and extending through the length of the sealing web, the nose portion being a general extension of the sealing web so as to assist the sealing web in its intended action of gliding freely and smoothly over a floor surface so that the sealing web does not foul with the floor surface, the nose portion being of suitable shape such as generally curved or non-linear shape so as to provide an effective nose to the sealing web so as to assist the sealing web in its intended action of freely and smoothly gliding over a floor surface particularly when the cross sectional curvature of the sealing web may be less acute than the cross sectional curvature of the nose portion or where the sealing web has been significantly rotated downwardly and away from the underside of the door edge so as to expose the free extremity of the sealing web to the line of contact between the sealing web and the floor surface.

17. A gap sealing section for sealing gaps between the underside of a door edge and the top of a floor surface, the sealing section being securable to the underside of a door edge, the sealing section having a mounting web on one side to allow direct flush mounting to the underside of a door edge and a sealing web at the opposite side for making contact with and freely and smoothly sliding over floor surfaces including floor coverings, the two webs being flexibly connected at one extremity along a line through their length so as to be movable by relative rotation about this line of their connection, the sealing web bearing against the top of a floor surface along a line which is generally below the area defined by the surface of the underside of the door edge, wherein a biasing web is included, the biasing web extending from the extremity of the sealing web furthest from the line of connection of the sealing and mounting webs and extending upwardly toward the door edge and inwardly toward the line of connection of the sealing and mounting webs.

18. A sealing section as claimed in claim 17 wherein the sealing web is of a generally curved or non-linear cross section and is sufficiently flexible and resilient so that when the free extremity of the biasing web in use is caused to rotate sufficiently upward so as to contact the underside of the mounting web, further free upward rotation of the sealing web being restricted by the action of the free extremity of the biasing web in contact with the underside of the mounting web so that further free upward rotation of the sealing weld is resiliently opposed by the resisting resilience of the material of the sealing web.

* * * * *